US005475894A

United States Patent [19]

Wildförster

[11] Patent Number: 5,475,894

[45] Date of Patent: Dec. 19, 1995

[54] HANDGRIP FOR A TOOL AND METHOD OF MAKING SAME

[75] Inventor: Horst Wildförster, Hemer, Germany

[73] Assignee: Stephan Witte GmbH & Co. KG, Hagen, Germany

[21] Appl. No.: 196,980

[22] Filed: Feb. 15, 1994

[30] Foreign Application Priority Data

Feb. 15, 1993 [DE] Germany ..... 9302036 U
Aug. 12, 1993 [DE] Germany ..... 43 27 082.4

[51] Int. Cl.[6] ..... B25G 1/10

[52] U.S. Cl. ..... 16/111 R; 16/DIG. 12; 81/489

[58] Field of Search ..... 16/111 R, DIG. 12, 16/DIG. 18, DIG. 19; 74/551.9; 81/177.1, 489; 273/75, 81 B, 81 D, 67 DB

[56] References Cited

U.S. PATENT DOCUMENTS

| | | | |
|---|---|---|---|
| 1,469,766 | 10/1923 | Blair | 273/75 |
| 1,749,207 | 3/1930 | Blair | 16/DIG. 12 |
| 2,309,933 | 2/1943 | Churchill | 273/75 |
| 3,586,080 | 6/1971 | Slany | 81/177.1 |
| 3,972,528 | 8/1976 | McCracken et al. | 74/551.9 |
| 4,012,039 | 3/1977 | Yerke | 74/551.9 |
| 4,373,718 | 2/1983 | Schmidt | 273/75 |
| 5,024,126 | 6/1991 | Holland-Letz et al. | 81/489 |
| 5,390,572 | 2/1995 | Gakhar et al. | 16/111 R |

FOREIGN PATENT DOCUMENTS

| | | | |
|---|---|---|---|
| 702449 | 4/1931 | France | 273/75 |
| 3301202 | 3/1984 | Germany | 81/177.1 |
| 59-220344 | 12/1984 | Japan | 273/75 |

*Primary Examiner*—Lowell A. Larson
*Assistant Examiner*—Donald M. Gurley
*Attorney, Agent, or Firm*—Herbert Dubno

[57] ABSTRACT

A handgrip for implements, utensils or tools, especially handtools and sporting implements, and particularly a screwdriver, has an elongated grip body formed at gripping regions engageable by the fingers or ball of a hand of a user with particles of inorganic or organic substances bonded to the grip.

21 Claims, 2 Drawing Sheets

HANDGRIP FOR A TOOL AND METHOD OF MAKING SAME

FIELD OF THE INVENTION

My present invention relates to a handgrip for an implement, tool, utensil, sports device or the like and particularly a handtool, especially a nut driver or screwdriver, having gripping surfaces or gripping regions which are engaged by the fingers and/or the ball of the hand of the user.

BACKGROUND OF THE INVENTION

Handgrips are commonly provided upon tools, implements or devices to which the hand of a user is to apply a torque or is to resist a torque which may be applied by engagement of the implement with some external force generator.

Typical of the implements or tools which are provided with grips adapted to receive a torque or to which a torque is to be applied are screwdrivers, nut drivers, screw starters and similar tools. Tools of this type generally are formed with a handgrip on a shank and require rotation by the hand of the user with the hand generating the force with which the nut or screw is driven or rotated, or the tip or point of the screw starter is driven into the wood.

Handgrips which are required to generate torque or which must resist application of torque from a load exerted on the implement are also known in conjunction with the shafts or shanks of sporting implements such as table tennis rackets or bats, tennis rackets and the like. In all such handgrips, a relatively high torque must be transferred between the grip and the hand and/or slippage of the hand relative to the grip must be avoided even when, for example, the hand is damp or greasy, oily, or otherwise soiled, or slippage of the hand may be induced by other means.

OBJECTS OF THE INVENTION

It is, therefore, the principal object of the present invention to provide a handgrip for the purposes described in which at least at gripping surfaces and/or gripping regions of the handgrip such slippage is prevented.

Another object of this invention is to provide an improved handgrip which in a simple and efficient manner can be made resistant to slip or, stated otherwise, can provide improved torque transfer between the tool, implement or device to which the grip is attached and the hand of the user engaging that grip.

It is yet another object of this invention to provide an improved handgrip for a tool, especially a screwdriver or like handtool, or a sporting implement like a racket, whereby drawbacks of earlier grips are avoided.

SUMMARY OF THE INVENTION

These objects and others which will become apparent hereinafter are attained, in accordance with the invention, by providing surfaces of the grip body which are engaged by the fingers and/or the ball of the hand of a user and/or gripping regions of that body completely or partly with friction-increasing powder, granules or similar friction particles so that slippage can be avoided.

More particularly, a handgrip for a tool, sports implement or the like, especially a handtool and most particularly a screwdriver, can comprise:

an elongated handgrip body formed with gripping surfaces engageable by fingers or a ball of a hand; and a layer of friction-enhancing particles bonded to the body extending over at least part of an area of each of the surfaces.

According to a feature of the invention, the friction-generating particles can have a particle size of 1 mm to 5 μm, preferably 200 μm to 5 μm as measured across the cross section or in diameter (mean diameter). The friction-increasing particle can be composed of wood meal, other organic or inorganic dusts or powders, granulates, including plastic granulates, minerals, corundum, silicon carbide or diamond dust or mixtures thereof.

According to a feature of the invention, the friction-enhancing particles or the like are fixed upon the gripping region or are at least in part embedded therein, for example utilizing a plastic (synthetic resin) as a carrier, binder or material from which the grip body is constituted, a synthetic resin adhesive or some other adhesive.

The friction particles can be applied only on the surface of the carrier or can be embedded therein but in any case it is preferred that only parts of the particles project from the carrier. The surface of the grip body can be composed of a plastic or coated with a plastic which can be softened by exposure to a solvent (e.g. in liquid or vapor form) or by heating (in the case of a thermoplastic) so that the particles can be pressed into the softened regions of the grip.

According to another feature of the invention, the friction particles are distributed in the mass of material forming the grip body and by removal of material (chemically or mechanically) at least projecting portions of the particles can be liberated and exposed.

The grip regions can be provided only over part of its area with the friction particles, especially in the case of grip configurations with polygonal cross section (e.g. triangular grip bodies with rounded edges) the flat or only slightly rounded regions between these edges being formed with the particles which are omitted from the edge regions.

The particles can be provided on a carrier which, for example, can be adhesively bonded to the grip body or can be set into the grip body, e.g. by being embedded in the material of the grip body. Other suitable means of attachment can also be used.

It has been found to be advantageous to press the particles into or onto the grip body and/or to apply the powder to the grip body electrostatically.

The friction particles can be rolled or pressed into the material of the grip body prior to hardening thereof with the bonding of the particles being then ensured by the hardening of the material of the grip body. The friction particles can be applied in different particle or grain sizes, with different particle size distributions or patterns and/or with different colorings or in conjunction with powders of different colors.

Furthermore, the friction particles in a fine particle size can be provided at the grip regions, i.e. the finger and ball of the hand region, while coarser particles may be provided elsewhere, i.e. between these regions.

The friction particles can be applied in zones directed radially, axially and/or in helix (screw) patterns with uniform particle sizes or different finer or coarser granulations in the various patterns or zones.

Advantageously, the friction particles are applied in a flaky pattern with the flakes or scales being oriented opposite the direction of torque application to the grip.

Indeed, the scales or flakes of the pattern can alternate in the radial direction of the gripping zones, preferably in a zone-wise manner and can be separated from one another especially by smooth zones.

According to a feature of the invention, moreover, the friction particles can include plastic fibers, mineral fibers or mixtures thereof or can be mixed with such fibers or such fibers can have other granules or particles mixed therewith. The fibers can have a fiber length of up to 3 mm and the granules mixed with the fiber material can have a particle size of up to 100 μm. The fibers can be composed of polyamide, polypropylene or cellulose acetate or mixtures thereof and, in the regions in which the granules and fibers are applied, the grip body can be coated or printed with an adhesive preferably selected from the group which consists of an epoxy resin or a polyurethane applied in a solvent.

Since the grip surfaces or regions of the grip body are completely or partially covered with friction increasing powders or like friction particles, even when the hand is damp or oily, a high torque can be transferred between the hand to the grip since the friction-enhancing particles largely prevent slippage of the hand. This effect is pronounced even when the grip itself has been significantly contaminated with materials functioning as lubricants, since the presence of such friction particles ensures a significant self-cleaning action when the grip is engaged by the hand of the user.

For torque transmission, the fingers of the user and the ball of the hand engage the gripping regions such that the particles can penetrate through any thin lubricant film in these regions and because of the direct and high friction engagement of the particles with the skin of the hand, high torques can be transmitted to the tool or other implement.

Preferably the grip body is composed of a plastic or other relatively hard or relatively soft, e.g. elastomeric material and, in the latter case, a hard core can be provided. Alternatively, a coreless structure can be used.

The friction particles are provided directly in the gripping regions and the grip can be round and completely covered with projecting particles, or of a polygonal configuration as described with the zones provided with the particles being straight or curved and the particles being located in flat or only lightly curved surfaces.

The application of the particles to the soft material of the grip can be effected either directly in conjunction with an injection molding process for forming the grip from the plastic or following softening of the grip in a subsequent operation.

Where the particle zones utilize particles of different particle sizes, the successive zones can follow one another in the radial or axial directions or also in diagonal or helical patterns on the grip. The distribution of particles in all cases should suit the ergonomic requirements so that the finest particles are located where the most sensitive parts of the hand can engage, i.e. at the locations engaged by the fingers or the ball of the hand. In regions adjoining the sensitive regions, a coarser particle pattern and size can be provided. Thus even a slipping of the hands in these regions will be avoided.

The flaky or scale pattern has been found to be especially preferred when it is desirable to provide increased resistance when the screwdriver is displaced by the hand in a screw-tightening direction but some slip is desired in the opposite sense. Of course, when similar torques must be transmitted in both directions, a reversal of the flake or scale orientation in the radial direction can be provided.

It has also been found to be advantageous as indicated to include as particles the fibers mentioned earlier or to provide such fibers in admixture with the granules.

BRIEF DESCRIPTION OF THE DRAWING

The above and other objects, features, and advantages will become more readily apparent from the following description, reference being made to the accompanying drawing in which:

FIG. 1 is an elevational view of a grip according to a first embodiment of the invention for a screwdriver or the like;

SPECIFIC DESCRIPTION

Figure 1:
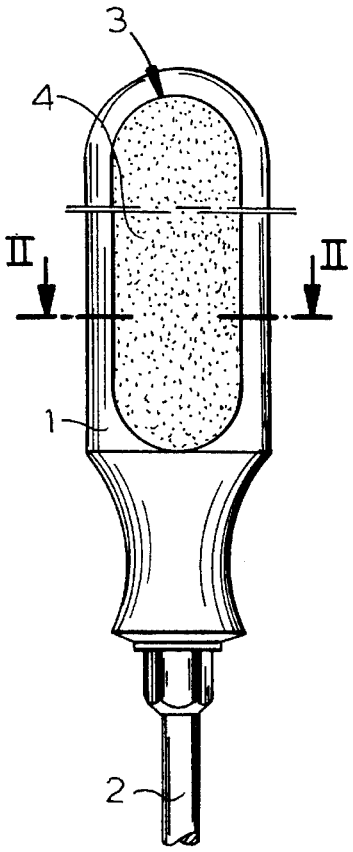

A hand grip 1 for a tool, especially a screwdriver having a blade 2 at the end of a shank, is formed with gripping surfaces or a gripping region 3 engageable by the fingers or the ball of the hand of the user.

According to the invention the gripping surfaces and/or gripping regions 3 are completely or partly provided with friction-enhancing powder of appropriate materials, granules and/or similar friction particles 4. The friction particles can have a size between about 1 mm to 5 μm, preferably 200 μm to 5 μm in cross section or diameter, advantageously measured as the mean diameter of the particles which can be generally polygonal or partially round.

The friction particles 4 can be composed of wood meal or other organic or inorganic dusts or powders, granules such as plastic granules, minerals, corundum, silicon carbide or diamond dusts or mixtures thereof.

According to FIG. 1, the particles 4 are partially embedded directly in the grip regions 3 of the grip body 1 and for that purpose the grip body may be composed of a plastic or may be coated with a plastic. The particles may also be held by a binder or synthetic resin adhesive or the like. The particles are thus located along the surface of the respective regions 3.

Figure 3:
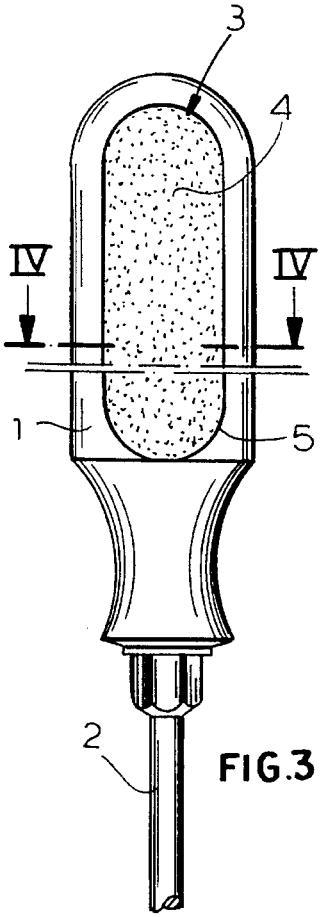
FIG. 3 is an elevational view of a second embodiment.
Figure 4:
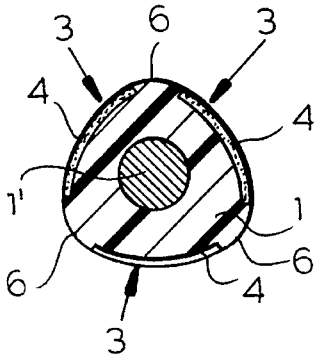
FIG. 4 is a cross sectional view taken along the line IV—IV of FIG. 3.
Figure 6:
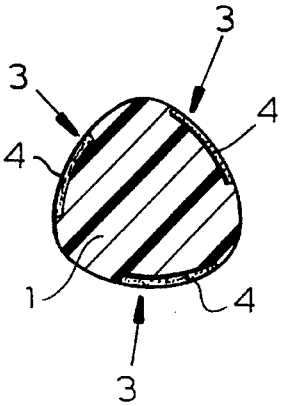
FIG. 6 is a section taken along the line VI—VI of FIG. 5.

In the embodiment of FIGS. 3 and 4, the particles 4 are provided on a carrier 5 which may be a synthetic resin strip in which the particles are embedded, the strip 5 being in turn embedded or bonded to the body 1 of synthetic resin which may have a core 1'. That core can have the shank 2 of the screwdriver affixed thereto. The particles can project partially from the carrier 5 which provides a permanent attachment for the particles to the body 1 of the handle. It is important that the particles project at least to a certain extent from the body 1 or the carrier strip on which the particles are mounted to ensure the requisite degree of friction increase by the presence of the particles.

As will be apparent, the particles 4 are provided at the grip regions substantially exclusively in the flat or only slightly curved grip regions between edges of the polygonal handle structures, the axial regions 6 being generally free from particles or being provided with particles at a lower concentration or of different sizes.

Figure 5:
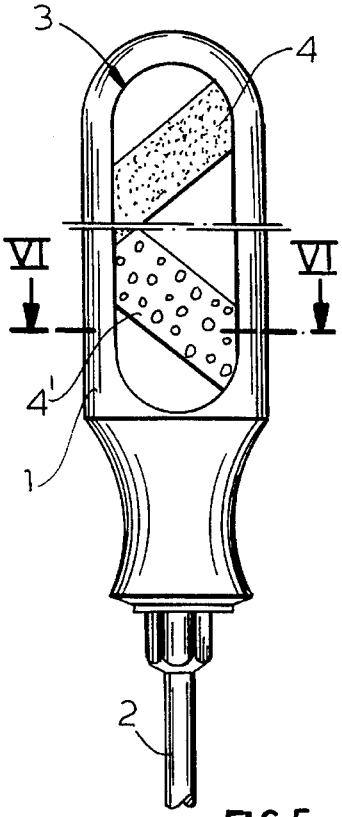
FIG. 5 is an elevational view of a grip illustrating still another embodiment.
Figure 2:
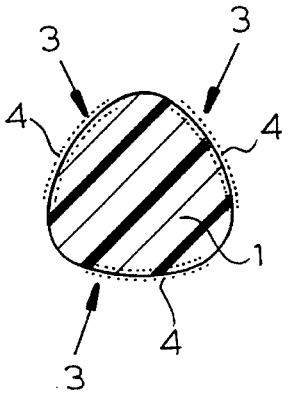
FIG. 2 is a cross sectional view taken along line II—II of FIG. 1.

In the embodiment of FIG. 5, the particles 4 and 4' have different sizes and are disposed in different distributions in quasidiagonal strips or zones which run generally along helices.

Figure 7:
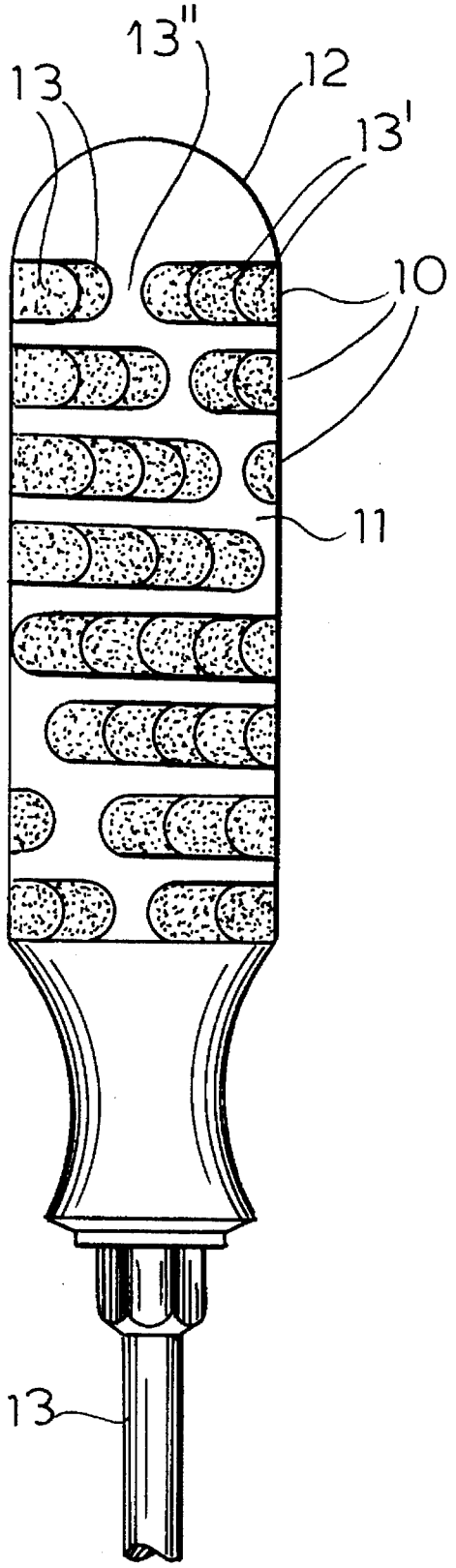
FIG. 7 is an elevational view illustrating yet another embodiment of the grip of the invention.

Referring to FIG. 7, it can be seen that the particles can be provided in strips 10 which can be axially spaced, leaving smooth gaps 11 between them for the handle 12 which has a shank or blade 13 in the manner described. Each of the strips 10 may be made up of a number of scale-like zones 13 of the particles where, within each strip the zones 13 and 13' are directed oppositely to one another and smooth spaces 13" are provided between them.

Figure 8:
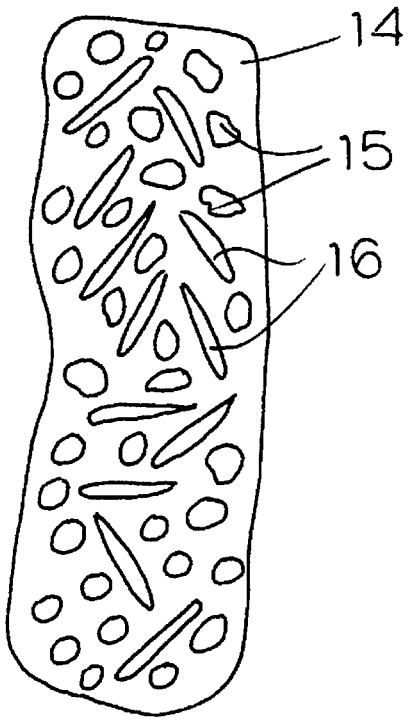
FIG. 8 is a detail view of a grip region or surface in which the fibers are provided in addition to the granules.

As can be seen from FIG. 8, which represents a region or zone engageable by the fingers or ball of the hand of a tool grip, drawn to a much larger scale than the scales provided heretofore, embedded in the body 14 of the grip are not only particles 15 in the manner previously described, but also pieces of filament or fiber 16 which can be composed of polyamide, polypropylene or cellulose acetate, with lengths of up to 3 mm disposed among particles 15 which have particle sizes up to 100 μm. The material 14 in which the particles and films are embedded are hardened epoxy resin or polyurethane adhesive.

I claim:

1. A handgrip for an implement having a shank affixed to the handgrip, said handgrip, comprising:

an elongated handgrip body formed with gripping surfaces engageable by fingers or a ball of a hand; and a layer of friction-enhancing particles bonded to said body extending over at least part of an area of each of said surfaces, said particles including granules with a particle size up to 100 μm and synthetic resin or mineral fibers of a length up to 3 mm, the synthetic resin fibers being selected from the group which consists of polyamide, polypropylene and cellulose acetate.

2. The handgrip defined in claim 1 wherein said particles have a mean particle size of substantially 1 mm to 5 μm.

3. The handgrip defined in claim 2 wherein said mean particle size is substantially 200 μm and 5 μm.

4. The handgrip defined in claim 1 wherein said particles are granules of an organic or inorganic powder.

5. The handgrip defined in claim 4 wherein said particles include particles selected from the group which consists of wood meal, plastic granules, corundum, silicon carbide, diamond dust and mixtures thereof.

6. The handgrip defined in claim 1, further comprising a layer of plastic forming a binder securing said particles to said body, said particles projecting only partly from said binder.

7. The handgrip defined in claim 1 wherein said body is composed at least in part of a plastic, said particles being partly embedded in said plastic.

8. The handgrip defined in claim 1 wherein said body has at least a surface portion of a plastic which after softening has said particles pressed into the softened surface portion.

9. The handgrip defined in claim 8 wherein said surface portion is a solvent-softened surface portion.

10. The handgrip defined in claim 8 wherein said surface portion is a heat-softened surface portion.

11. The handgrip defined in claim 1 wherein said particles are dispersed throughout said body and are partly exposed at said gripping surfaces by removal of material from said body around the particles exposed at said surfaces.

12. The handgrip defined in claim 1 wherein said body has a generally polygonal cross section with said surfaces being regions which are at most slightly curved and are disposed between rounded edge portions, said particles being provided substantially exclusively on said regions.

13. The handgrip defined in 1 wherein said particles are provided on a carrier bonded to said body at said surfaces.

14. The handgrip defined in claim 1 wherein said particles are bonded to said body by impressing said particles into said body or said particles are electrostatically applied to said body.

15. The handgrip defined in claim 1 wherein said particles are applied in radial, axial or helical zones of particles of the same size or in zones of different finer or coarser particles.

16. The handgrip defined in claim 1 wherein said particles are pressed into material of said body before hardening thereof and the body is then hardened to anchor said particles in said body at said surfaces.

17. The handgrip defined in claim 1 wherein said particles are applied to said surfaces in different particle sizes, different distributions and with different colors.

18. The handgrip defined in claim 1 wherein said particles form a scaly pattern on said surfaces oriented in a direction opposite a direction in which torque is applied to said body.

19. The handgrip defined in claim 1 wherein said particles are provided in scaly patterns on said surfaces separated by smooth zones and with successive scaly patterns alternating in orientation.

20. The handgrip defined in claim 1 wherein the fibers and granules are bonded to said body by a printed or coated adhesive selected from the group which consists of epoxy resin or polyurethane applied in a solvent to said body.

21. A method of making a handgrip for a tool, especially a screwdriver, which comprises forming a grip body connected to a shank, shaping gripping regions on said body for engagement by fingers or a ball of a hand of a user, and increasing friction at least in said regions by providing said regions with particles having a particle size of 1 mm to 5 μm in mean diameter and bonding said particles on said body, said particles including granules with a particle size up to 100 μm and synthetic resin or mineral fibers of a length up to 3 mm, the synthetic resin fibers being selected from the group which consists of polyamide, polypropylene and cellulose acetate.

* * * * *